US006807772B2

(12) United States Patent
Halter

(10) Patent No.: US 6,807,772 B2
(45) Date of Patent: Oct. 26, 2004

(54) ROTATING/SLIDING SHADE ASSEMBLY

(76) Inventor: John C. Halter, 4400 Sunbelt Dr., Addison, TX (US) 75001

( * ) Notice: Subject to any disclaimer, the term of this patent is extended or adjusted under 35 U.S.C. 154(b) by 28 days.

(21) Appl. No.: 10/233,709

(22) Filed: Sep. 3, 2002

(65) Prior Publication Data

US 2004/0040211 A1 Mar. 4, 2004

(51) Int. Cl.[7] ..... E06B 7/02
(52) U.S. Cl. ..... 49/39; 49/38
(58) Field of Search ..... 49/38, 39, 82.1; 454/211, 224

(56) References Cited

U.S. PATENT DOCUMENTS 5,016,390 A * 5/1991 Johnson ..... 49/38
5,469,658 A * 11/1995 Digianni et al. ..... 49/82.1
5,564,229 A * 10/1996 Noska ..... 49/39
5,608,990 A * 3/1997 Kyle ..... 49/38
5,918,417 A * 7/1999 Kinder ..... 49/39

* cited by examiner

*Primary Examiner*—Jerry Redman
(74) *Attorney, Agent, or Firm*—John E. Vandigriff

(57) ABSTRACT

A shutter device for covering windows provides two shutters, each shutter having clear and opaque areas to provide and block vision though the shutter as one panel is moved with respect to the other. The shutter device is adaptable to semicircular, circular and rectangular windows. The shutter utilizes two panel, one fixed panel mounted on widow and one moveable panel, of clear material, such as glass or plastic, each panel has alternate clear and opaque areas. When the two panels are aligned so that clear areas are adjacent (open position), there is viewing through the window. When an opaque area is aligned over a clear area, vision through the shutter (closed position) is blocked.

18 Claims, 5 Drawing Sheets

ROTATING/SLIDING SHADE ASSEMBLY

FIELD OF THE INVENTION

The invention relates to window shutters and coverings, and more particularly to a window covering including two parts, each part having clear and opaque regions that block view when in one position in relation to each other and permits view through the covering when in another position.

BACKGROUND OF THE INVENTION

Various shutter/blind apparatus have been made to close semicircular window openings. For example, in U.S. Pat. No. 6,341,447, a plurality of rotatable slats are mounted in a semicircular frame. The slats are rotated to provide a view or block a view through the apparatus.

In U.S. Pat. No. 5,823,241, a window blind has horizontal slats cut to fit into a semicircular window.

In U.S. Pat. No. 5,662,153, a frame supports a fan-shaped pleated shade that is rotated from a folded open position to an unfolded closed position to that the shade covers a semicircular wind adjacent to the shade.

The above patents show examples of shutter apparatus for opening and closing semicircular windows, but are described only for purposed of showing examples of prior art for semicircular window shutters.

SUMMARY OF THE INVENTION

The invention is to a shutter device for covering windows and providing a means for "opening" and "closing" the shutter to provide and block vision though the shutter. The shutter device is adaptable to semicircular, circular and rectangular windows. The shutter utilizes two panels of clear material, such as glass and plastic, each panel has alternate clear and opaque areas. When the two panels are aligned so that clear areas are adjacent (open position), there is viewing through the window. When an opaque area is aligned over a clear area, vision through the shutter (closed position) is blocked.

A first of the two shutter panels is secured to a window by attachment devices such as hook and loop fasteners, two sided adhesive devices, and screws. The second shutter panel is moveably mounted over the first shutter panel. When the shutter is in the "open" position, the clear areas on both shutter panels are aligned. When the shutter is in the "closed" position, the opaque areas on the second shutter panel are moved to be adjacent to the clear areas on the first shutter panel blocking vision through the shutter.

BRIEF DESCRIPTIONS OF THE DRAWINGS

Figure 3:
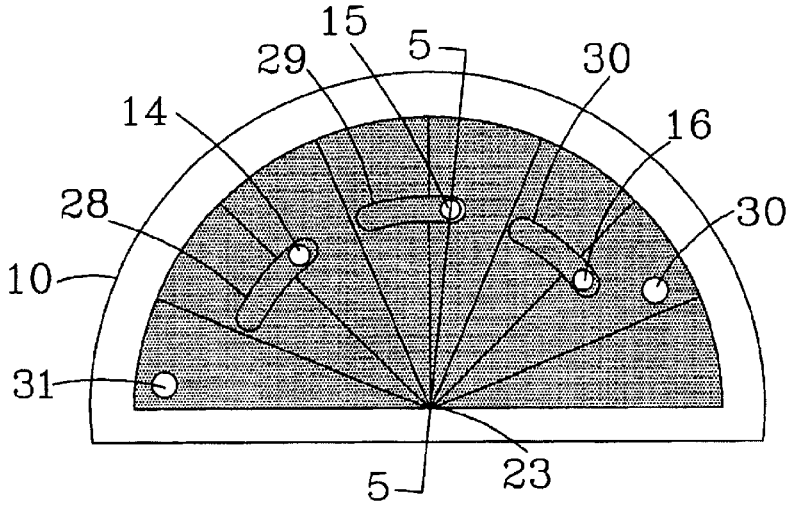
FIG. 3 shows the second shutter panel mounted over the first shutter panel in the semicircular window, and in a closed position.
Figure 5:
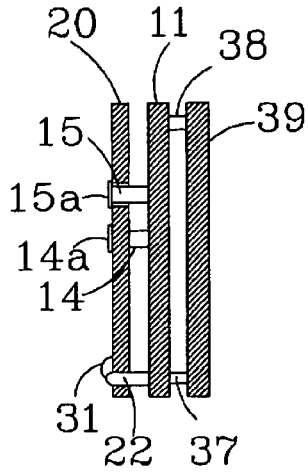
Figure 4:
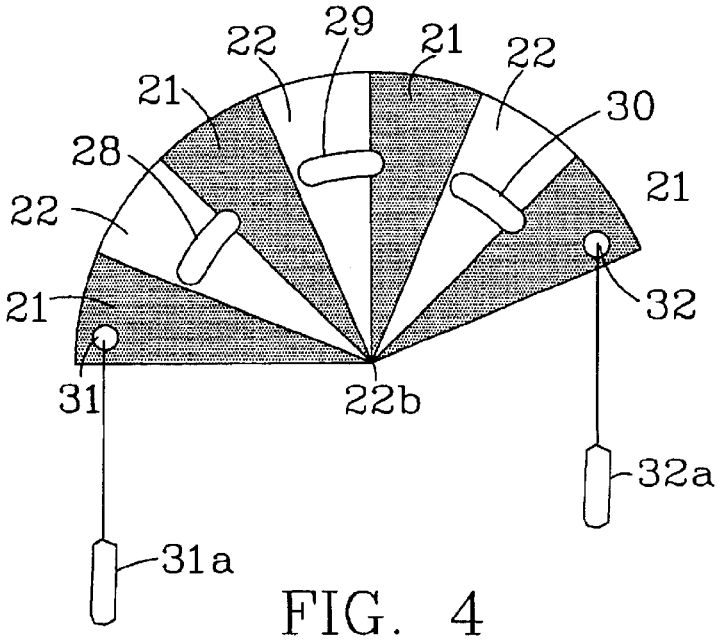
Figure 3A:
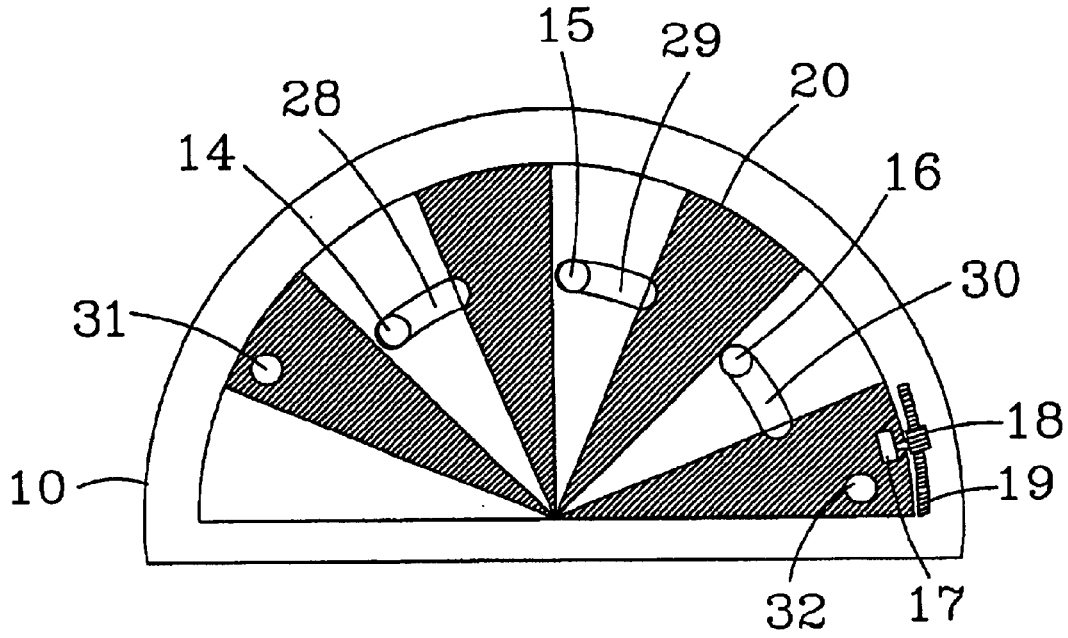
Figure 3B:
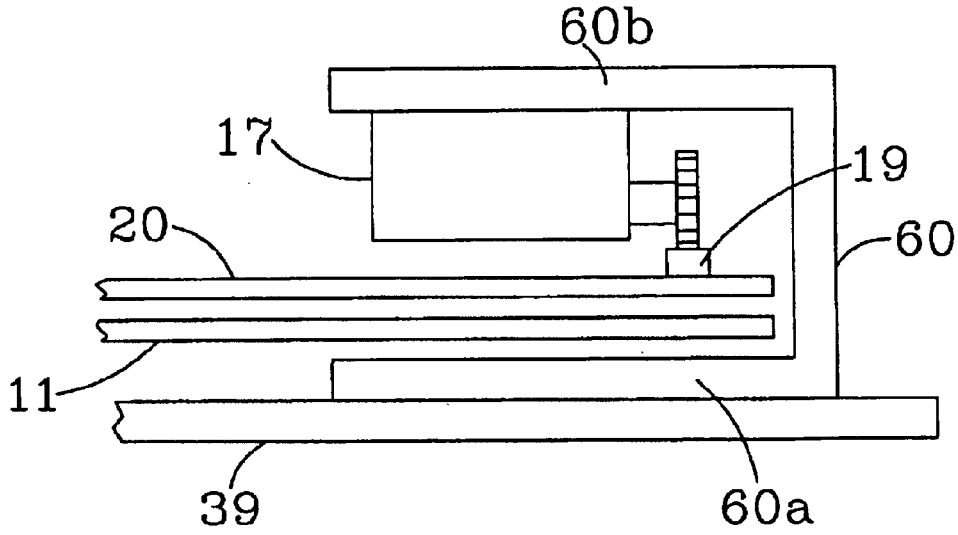
Figure 6:
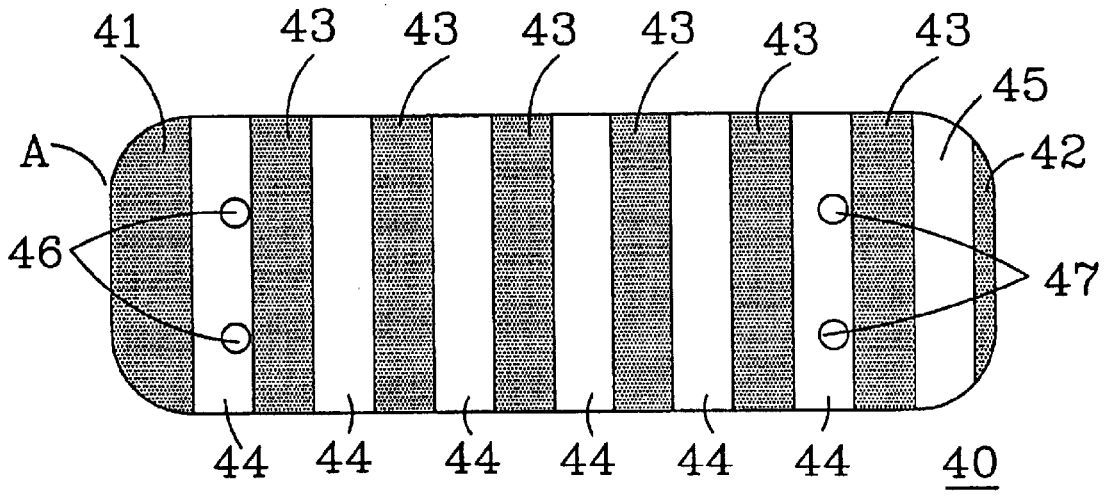
Figure 7:
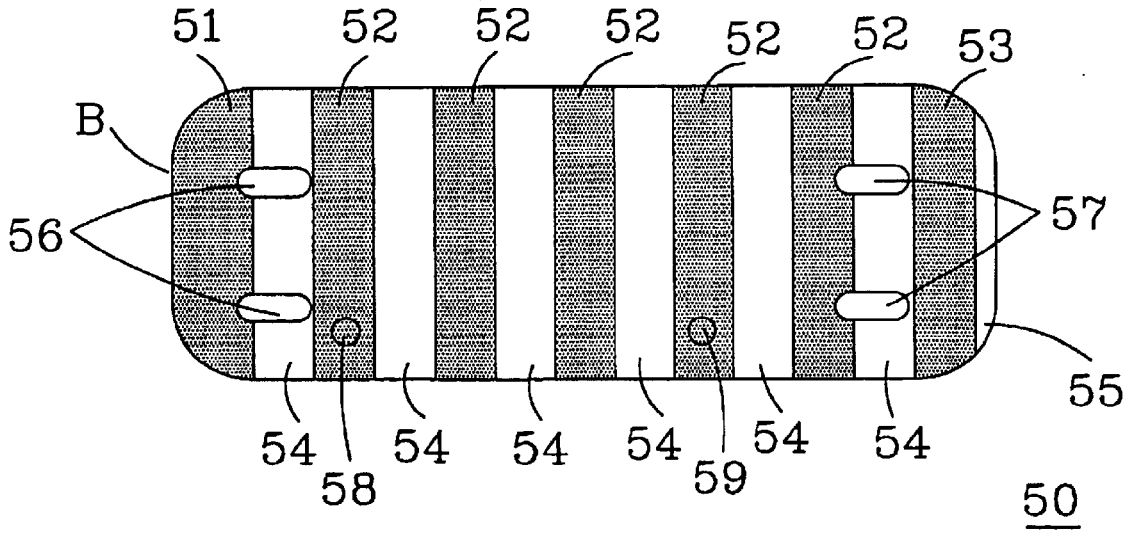
Figure 8:
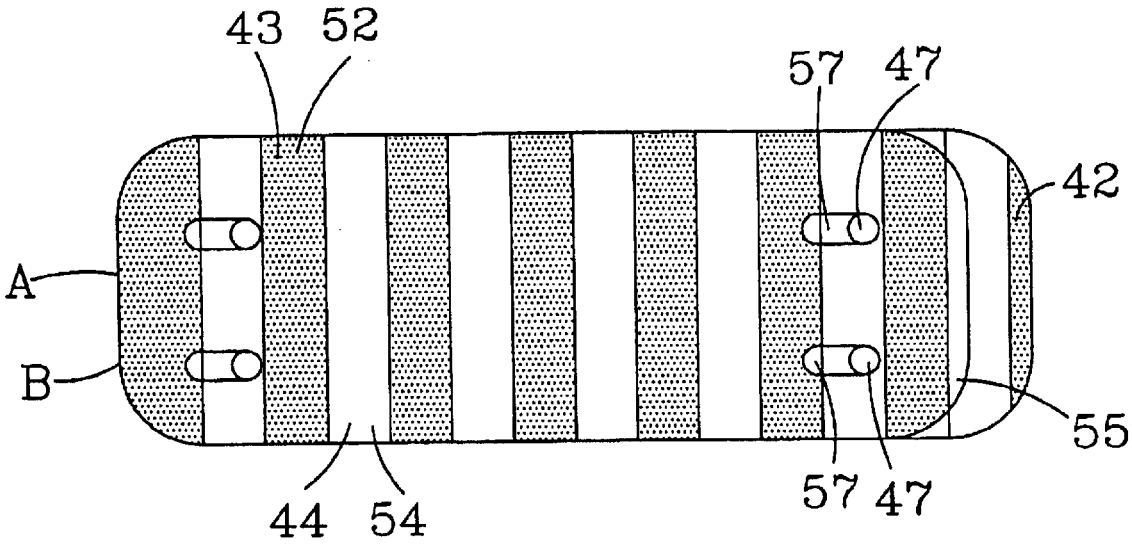
Figure 9:
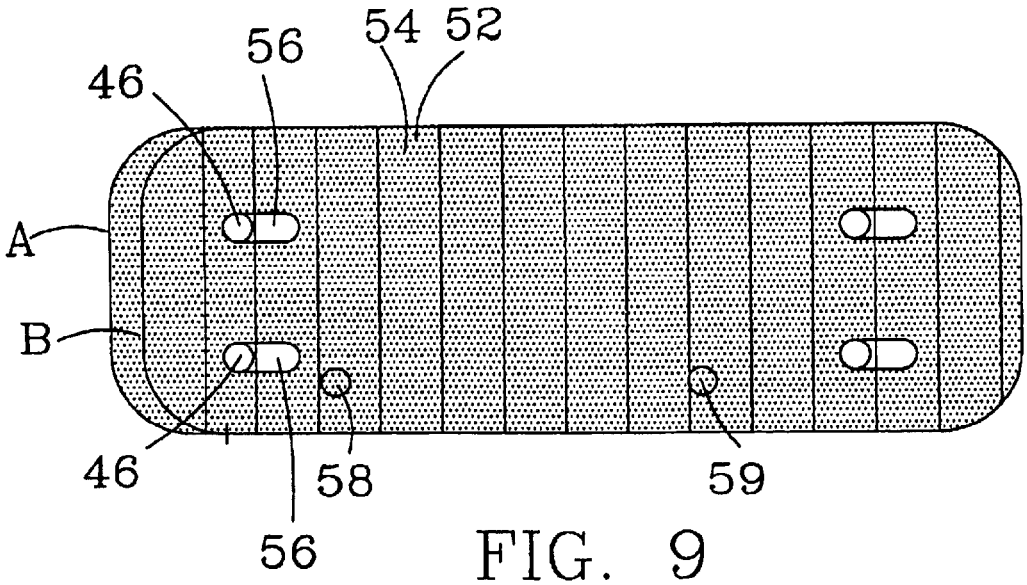

FIG. 3*a* shows a shutter according to the present invention that can be open and closed by a remote control;

FIG. 3*b* shows an alternate motor mounting in the event that there is no window frame on which to mounted the motor or rack gear;

FIG. 4 shows the second shutter panels positioned in the closed position;

FIG. 5 is cross-section view through section 5—5 of FIG. 3;

FIG. 6 shows a first shutter panel in a rectangular format;

FIG. 7 shows a second shutter panel in a rectangular format;

FIG. 8 shows the second shutter panel mounted over the first shutter panels showing the shutter in an "open" position;

FIG. 9 shows the second shutter panel mounted over the first shutter panels showing the shutter in an "closed" position;

DESCRIPTION OF A PREFERRED EMBODIMENT

Figure 1:
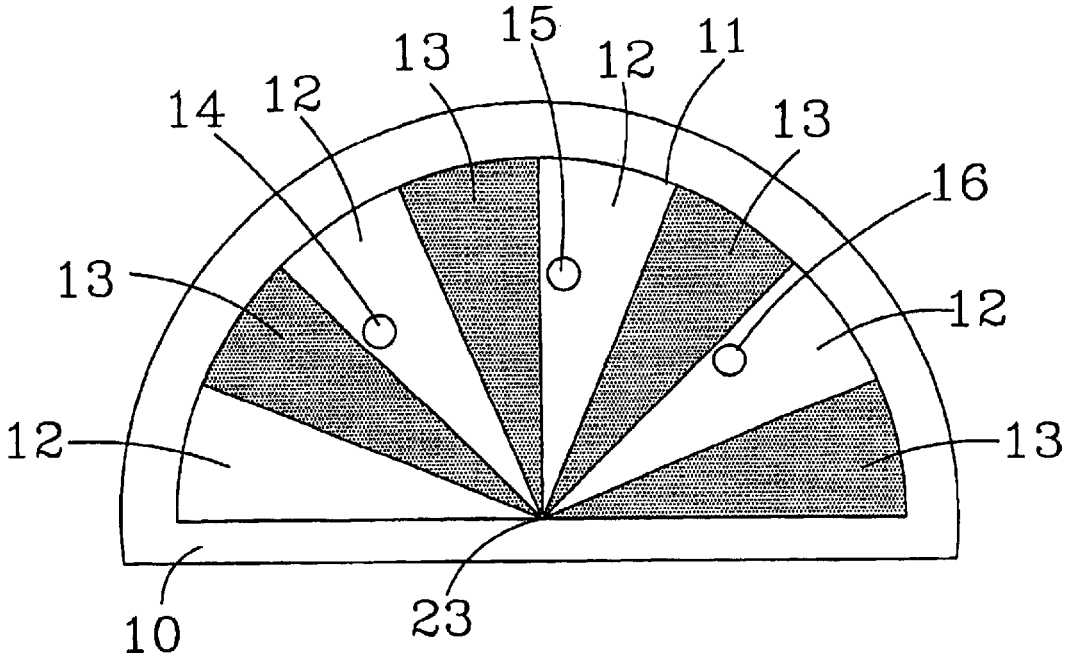
FIG. 1 shows a first shutter panel of the invention mounted in a semicircular window.

FIG. 1 shows a first shutter panel 11 mounted in a circular window 10. First shutter panel 11 is semicircular shaped with alter pie-shaped clear and opaque regions. Regions 12 are clear. Shutter panel 11 may be made of glass or clear plastic material such as Lexan® or plexiglass. The opaque regions 13 may be made opaque, for example, by paint or silk screening. There are three posts 14, 15 and 16 that extend outward from first shutter panel 11. The number of mounting posts may depend upon the size of the shutter panels. Another post 23 extends outward from the bottom center of first shutter panel 11.

Figure 2:
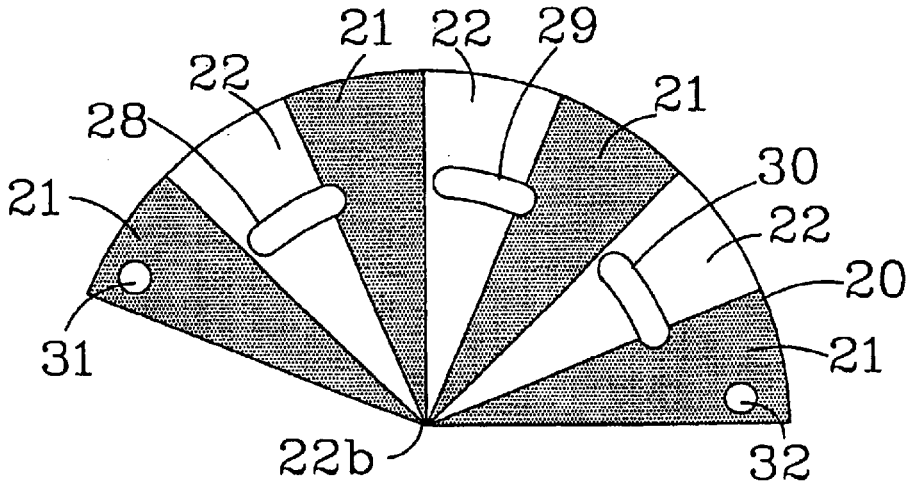
FIG. 2 shows the second shutter panel in an open position.

FIG. 2 shows the second shutter panel 20 with clear areas 22, and opaque areas 21. The clear and opaque alternating on panel 20. Panel 20 has three slots 28, 29 and 30 through which posts 14, 15 and 16, respectively, extend when shutter panel is mounted over first shutter panel 11. Second shutter panel 20 is pivotally mounted on post 23 of first shutter panel 11. It should be noted in comparing first shutter 11 in FIG. 1 and second shutter panel in FIG. 2, that second shutter panel 20 has one less pie shaped area than shutter panel 11. As illustrated in FIG. 1 and FIG. 2, there is no pie shaped area on second shutter panel 20 corresponding to the first clear area 12 on the left side of shutter panel 11 second shutter panel 20 has two posts or tabs 31 and 32 for rotating second shutter panel 20 with respect to first shutter panel 11. If the shutter is not mounted with in a person reach, a tassel may be secured to each tab to allow the second shutter panel to be rotated. Tassels 31*a* and 32*a* are shown in FIG. 4. By pulling on tassel 31*a*, the shutter panel will be rotated counter clockwise, and by pulling of tassel 32*a*, the shutter panel will be rotated clockwise.

FIG. 3 shows the shutter apparatus mounted in a window 10 with the second shutter panel rotated, in viewing FIG. 3, counter clockwise so that the opaque areas 21 of the second shutter panel 20 are over the clear areas of first shutter panel 11. Second shutter panel 20 rotates at 23 with slots 28, 29 and 30 moving along posts 14, 15 and 16.

FIG. 3*a* shows the shutter in an open position. A radio controlled motor is mounted on second panel 20. Motor 17 turns a gear 18 that engages a rack gear 19 mounted on the window frame 10. Using a remode control device, the shutter maybe opened or closed.

FIG. 3*b* shows an alternate motor mounting in the event that there is no window frame on which to mounted the motor or rack gear. In FIG. 3*a* the lower leg 60*a* of frame 60 is secured to window glass 39. Frame 60 is U-shaped and extends around shutter panels 11 and 20. A rack gear 10 is mounted on shutter panel 20 and the remote controlled motor 17 is mounted on the upper leg 60*b*.

FIG. 4 shows second shutter panel 20 alone in the counter clockwise position. When compared with second shutter panel 20 shown in FIG. 2, it is seen that second shutter panel 20 has rotated counter clockwise one pie shaped section.

FIG. 5 is a cross-section view across section 5—5 of FIG. 3. Shown is a glass window pane 39 to which is attached first shutter panel 11 by attachment devices 37 and 38. Post 15, and posts 14, and 16 (FIG. 3) are attached to first shutter panel 11. Posts 14, 15 and 16 extend through openings 28, 29 and 30, FIG. 3, to mount second shutter panel 20 to first shutter panel 11. Second shutter panel is rotatably mounted on pin 23. Panel 20 is held on posts 14, 15 and 16 by caps 14*a* and 15*a* on the ends of posts 14 and 15.

FIGS. 6 and 7 show shutter panels for a rectangular window. The corners of the panels are shown rounded, but may be square. FIG. 6 is the first panel 40 that is mounted to a window glass similarly to the mounting of panel 11 (FIG. 5) to glass panel 39 by adhesive or other type material. Panel 40 has alternate opaque 43 and clear 44 areas. Opaque area 41 is enlarged to provide cover for the curved corners of the opaque area 51 of panel 50, FIG. 7, area 42 is a smaller area. There are two pairs of mounting posts 46 and 47 on which panel 50 is mounted FIG. 7 shows second panel 50 with alternated opaque areas 51, 52 and 53, and clear areas 54 and 55. There are two pairs of slots 56 and 57 through which posts 46 and 47 extend and on which panel 50 is slidably mounted. The two posts 58 and 59 are for sliding panel 50 back and forth along posts 46 and 47.

FIG. 8 shows panel 50 mounted with panel 40 to permit viewing through the shutter. Opaque area 43 of panel 40 is over opaque area 52 of panel 40. Similarly, clear area 44 of panel 40 is over clear area 54 of panel 50. In FIG. 9, panel 50 has been move to the right so that opaque areas 52 on panel 50 are over clear areas 44 are on panel 40, blocking the view through the shutter. On each of the panel 11 and 20, FIGS. 1–4 and panels 40 and 50, FIGS. 6–9, the opaque areas are slightly wider so that they over lap the clear areas to prevent viewing thorough thin lines between the opaque areas when the shutter is closed. A radio control opener can also used with the shutter system of FIGS. 6–9, similar to the one shown in FIG. 3*a*.

The shutter devices described above relate to a semicircular format and a rectangular format, but the shutter devices are not limited to these two formats. In each of the configurations, the first panel is spaced from the window glass, and the second panel is spaced from the first panel. These separations prevent condensation between the panels and glass, but provide an insulation factor, keeping heat from penetrating the window and panels. The shutter device has been show attached to the window glass, but the first shutter panel may be attached to a frame and mounted over a window or door glass.

The enlarged opaque areas on the panels allow maximum privacy when closed, as maximum visibility when opened. This feature is important, especially on small windows found on boats. The opaque areas can be adjusted, depending upon the shutter format.

What is claimed:

1. A window shutter assembly, comprising:

a first fixed panel having clear and opaque areas thereon;

a second movable panel having clear and opaque areas thereon;

first mounting means for securing the first panel to a window;

second mounting means on said first panel extending through slots in said second panel for moveably mounting the second panel on and adjacent to the first panel; and means on said second panel for moving the second panel on said second mounting means with respect to the first panel to align opaque areas on the second panel with the clear areas on the first panel to block viewing through the shutter assembly, and for aligning the clear areas on each of the first and second panels to allow viewing though the shutter panel.

2. The window shutter assembly according to claim 1, wherein the first and second panels are made from at east one of clear plastic and glass.

3. The window shutter assembly according to claim 1, wherein the opaque areas of the first and second panels are at least one of a painted and silk-screened area.

4. The window shutter assembly according to claim 1, wherein the first panel is attached to a window by at least one of an adhesive material, including tape, an hook and loop strips.

5. The window shutter assembly according to claim 1, wherein the first panel has posts mounted thereon, and the second panel is movably mounted on said posts.

6. The window shutter assembly according to claim 1, including at least one device of the second panel for moving the second panel in relation to the fixed first panel.

7. The window shutter assembly according to claim 1, including a remote control device for remotely moving the second panel to open and close the shutter.

8. The window shutter assembly according to claim 1, where in the first and second panels are semicircular in shape.

9. The window shutter assembly according to claim 1, wherein the first and second panels are rectangular in shape.

10. A window shutter assembly, comprising:

first fixed and second movable panels are attached to each other by posts extending from said first panel and extending through slots in said second panel, each panel having clear and opaque areas thereon;

a first mounting means for securing the first panel to a window; and means for moving the second panel with respect to the first panel to align opaque areas on the second panel with the clear areas on the first panel to block viewing through the shutter assembly, and for aligning the clear areas on each of the first and second panels to allow viewing though the shutter panel.

11. The window shutter assembly according to claim 10, wherein the first and second panels are made from at least one of clear plastic and glass.

12. The window shutter assembly according to claim 10, wherein the opaque areas of the first and second panels is at least one of a painted and silk-screened area.

13. The window shutter assembly according to claim 10, wherein the first panel is attached to a window by an adhesive material, including tape, hook and loop strips.

14. The window shutter assembly according to claim 10, wherein said posts are securely attached to the first panel, and said posts extend through the second panel which is movably mounted thereon.

15. The window shutter assembly according to claim 10, including at least one post on the second panel for moving the second panel in relation to the first panel.

16. The window shutter assembly according to claim 10, including a remote control device for remotely moving the second panel to open and close the shutter.

17. The window shutter assembly according to claim 10, where in the first and second panels are semicircular in shape.

18. The window shutter assembly according to claim 10, wherein the first arid second panels are rectangular in shape.

* * * * *